US008951028B2

(12) United States Patent
Genissieux et al.

(10) Patent No.: US 8,951,028 B2
(45) Date of Patent: Feb. 10, 2015

(54) ROTARY MACHINE OF THE DEFORMABLE RHOMBUS TYPE COMPRISING AN IMPROVED TRANSMISSION MECHANISM

(75) Inventors: Vincent Genissieux, Grenoble (FR); Jean-Pierre Ambert, Ruffey sur Seille (FR); Jean-Thomas Collomb, Eybens (FR)

(73) Assignees: Vincent Genissieux, Grenoble (FR); Jean-Pierre Ambert, Ruffey sur Seille (FR)

( * ) Notice: Subject to any disclaimer, the term of this patent is extended or adjusted under 35 U.S.C. 154(b) by 932 days.

(21) Appl. No.: 13/128,692

(22) PCT Filed: Nov. 10, 2009

(86) PCT No.: PCT/FR2009/001294

§ 371 (c)(1),
(2), (4) Date: Aug. 1, 2011

(87) PCT Pub. No.: WO2010/055223

PCT Pub. Date: May 20, 2010

(65) Prior Publication Data

US 2011/0280757 A1 Nov. 17, 2011

(30) Foreign Application Priority Data

Nov. 12, 2008 (FR) ..... 08 06304

(51) Int. Cl.
*F01C 1/324* (2006.01)
*F01C 1/32* (2006.01)
(Continued)

(52) U.S. Cl.
CPC ..... *F01C 1/324* (2013.01); *F01C 1/332* (2013.01); *F01C 1/40* (2013.01); *F01C 17/00* (2013.01); *F01C 21/0836* (2013.01); *F03C 2/30* (2013.01); *F02B 53/02* (2013.01)
USPC ..... 418/253; 123/241

(58) Field of Classification Search
CPC ..... F01C 17/00; F01C 1/324; F01C 1/332; F01C 1/40; F01C 21/0836; F03C 2/30
USPC ..... 418/253–258; 123/241
See application file for complete search history.

(56) References Cited

U.S. PATENT DOCUMENTS 716,970 A * 12/1902 Werner ..... 418/253
3,196,854 A 7/1965 Novak
(Continued)

FOREIGN PATENT DOCUMENTS

CA 997998 10/1976
CA 2 341 798 9/2002
(Continued)

*Primary Examiner* — Mary A Davis
(74) *Attorney, Agent, or Firm* — Pillsbury Winthrop Shaw Pittman LLP

(57) ABSTRACT

A rotary machine with a deformable rhomb includes a rotor formed by a deformable rhomb in contact, with or without clearance, with an internal surface of a housing forming a stator and/or with an external surface of a central crown, the deformable rhomb including four pistons connected one following the other by a pivotal hinge with an axis parallel to a longitudinal axis of the housing and thus forming a closed chain; a transmission mechanism to transmit movement between the pistons and a rotation shaft coaxial to a central axis of the machine, the transmission mechanism including a first rolling body mounted fixedly on at least one piston, an axis of the first rolling body passing in the center of the piston and connected to a second rolling body, a center of which passing through the central axis of the machine and being integral with the rotation shaft, the first rolling body being connected to the second rolling body directly or by an intermediate transmission member, wherein a demultiplication ratio between the first and the second rolling body is equal to 2 and is positive.

19 Claims, 9 Drawing Sheets

(51) Int. Cl.

| | |
|---|---|
| ***F01C 1/40*** | (2006.01) |
| ***F01C 17/00*** | (2006.01) |
| ***F02B 53/02*** | (2006.01) |
| ***F01C 1/332*** | (2006.01) |
| ***F01C 21/08*** | (2006.01) |
| ***F03C 2/30*** | (2006.01) |

(56) References Cited

U.S. PATENT DOCUMENTS

| | | | | | |
|---|---|---|---|---|---|
| 3,295,505 | A * | 1/1967 | Jordan | ..... | 123/241 |
| 3,349,757 | A | 10/1967 | Artajo | | |
| 3,369,529 | A | 2/1968 | Jordan | | |
| 3,387,596 | A | 6/1968 | Niemand | | |
| 3,642,391 | A * | 2/1972 | Wilson | ..... | 418/253 |
| 3,918,415 | A * | 11/1975 | Ishida | ..... | 418/253 |
| 4,181,481 | A * | 1/1980 | Jordan | ..... | 418/253 |
| 6,718,938 | B2 * | 4/2004 | Szorenyi | ..... | 123/241 |
| 6,899,075 | B2 * | 5/2005 | Saint-Hilaire et al. | ..... | 123/241 |
| 7,178,502 | B2 * | 2/2007 | Okulov | ..... | 123/241 |
| 2003/0062020 | A1 | 4/2003 | Okulov | | |
| 2007/0023001 | A1 | 2/2007 | Okulov | | |

FOREIGN PATENT DOCUMENTS

| | | |
|---|---|---|
| EP | 1295 012 | 3/2003 |
| FR | 1404453 | 2/1964 |
| FR | 2145133 | 1/1973 |
| FR | 2374512 | 7/1978 |
| FR | 2493 397 | 5/1982 |
| WO | WO 2004/070169 | 8/2004 |
| WO | WO 2007/093649 | 8/2007 |
| WO | WO 01/88341 | 11/2011 |
| WO | WO2013053062 A * | 4/2013 |

* cited by examiner

ROTARY MACHINE OF THE DEFORMABLE RHOMBUS TYPE COMPRISING AN IMPROVED TRANSMISSION MECHANISM

CROSS REFERENCE TO RELATED APPLICATIONS

This application is the U.S. National Stage of PCT/FR2009/001294, filed Nov. 10, 2009, which in turn claims priority to French Patent Application No. 0806304, filed Nov. 12, 2008, the entire contents of all applications are incorporated herein by reference in their entireties.

FIELD OF THE INVENTION

The present invention concerns a rotary machine with a deformable rhomb (RMDR) and it concerns more particularly a transmission mechanism for such a machine.

A rotary machine with a deformable rhomb generally comprises a fixed assembly or stator, and a mobile assembly or rotor, having a rhomb shape articulated at its summits and turning around its centre, able to be deformed in particular during its rotation. Each side of the rhomb determines, with the internal profile having a general oval shape of the stator, a variable-volume chamber during the movement of the rotor. The sides of the articulated rhomb are realized by plates, designated pistons, having an external surface of generally curvilinear shape. These pistons are sometimes provided, in their contact zone with the internal profile of the stator, with tightness segments.

Such a machine can be used as a combustion engine, turbine, compressor, pump, choke, grinder, mixer of fluids—charged or not. It presents the advantage of having a fixed centre of gravity, thus being able to avoid vibrations, of being able to reach compressions equivalent to those of piston motors, of having a greater flow than piston motors, of having a greater pressure ratio than that of turbines and of being simpler than the majority of generally known machines fulfilling the same functions.

PRIOR ART

Rotary machines with a deformable rhomb (RMDR) have a stator generally constituted by a non-circular cylindrical housing (understood to be a cylinder, the guiding curve of which is not a circle) exterior to the rotor in the shape of a rhomb. The rotor comprises a plurality (most frequently four) of rotary elements articulated with each other at the level of their adjacent edges according to a pivot connection of an axis parallel to the longitudinal axis passing in the centre of the housing, each of the rotary elements delimiting with the inner wall of the housing a chamber or cavity of variable volume. These machines have been described for a long time, but they are scarcely used. In the manner of the Wankel engine, which is well known to the man skilled in the art, these machines haven been firstly imagined as a combustion engine. The patent FR 1 404 453 (J. Lemaitre), the U.S. Pat. No. 3,196,854 (A. Novak), the patent FR 2 145 133 (J. Martin Artajo), the patent application WO 01/88341 (P. Szorenyi), the patent CA 997998 (E. Steinbrink) and the patent application FR 2 493 397 (J. P. Ambert) describe the idea and the theoretical conception of such an engine. The patent application WO 2004/070169 (G. Saint-Hilaire) describes a rotary internal combustion engine with a deformable rhomb, detailing its structure, but without explaining how its tightness is ensured under the operating conditions of a combustion engine, and without detailing, either, the materials suited to holding the pressures and temperatures in such a machine, or giving solutions concerning the expansion of the materials or the compensation of the functional clearances. Other combustion engines of the RMDR type are described for example in the documents EP 1 295 012 B1 (Nivesh SA) and U.S. Pat. No. 3,387,596 (L. Niemand).

When the RMDR operates as a rotary motor, the rotation torque of the rotor must be able to be recovered by a transmission shaft so that it can be used by a connected device, for example via a gear box, by the wheels of an automobile. When it operates as a compressor or rotary pump, the movement must be able to be imparted to the rotor from a central transmission shaft. Several documents describe solutions for such transmission mechanisms.

The document FR 2 493 397 (J. P. Ambert) describes a rotary motor able to function as an internal combustion heat engine or as a pump or compressor comprising four articulated pistons forming a deformable rhomb which are articulated at their centre on two cranks with two opposed arms. One of the cranks entrains a transmission shaft centred with the stator, the other crank being mounted freely in rotation around the same shaft, due to the fact that the angle between the two cranks varies on deformation of the rhomb. This solution, drawing on the transmission of the movement solely by one median arm does not ensure a movement at a uniform speed of the diagonals of the rhomb, which can induce parasitic torques due to the dynamics of the machine, having as a consequence a non-uniform rotation of the central shaft.

The document U.S. Pat. No. 3,369,529 (A. Jordan) describes an internal combustion engine with articulated rotary pistons to form a deformable rhomb inside a housing of ovoidal transverse section and a mechanism for transmission of the movement of the pistons to a central shaft, the transmission mechanism comprising four distinct arms integral with the shaft, each being arranged between the shaft and an articulation roller and being of variable length radially. Ensuring, certainly, a more uniform rotation of the central shaft, this solution presents as a disadvantage the fact of not providing support to the pistons to bear the high traction or compression forces; pistons which, because of this, are projected against the internal surface of the stator. Such a solution can lead to a premature wear of the components of the machine, with the appearance of clearances being able to impair in the end the good functioning of the machine.

The document FR 2 374 512 (A. Jordan) describes an internal combustion engine with rotary pistons, comprising in particular four articulated pistons able to oscillate in rotation, applying themselves rigidly at their end by articulation rollers and joint-bearing rollers against the internal surface of an interior chamber and comprising a mechanism for the transmission of the forces of the pistons to a central shaft. The transmission mechanism comprises a pair of arms integral with the central shaft and a pair of arms mounted so as to be able to turn about the shaft, each pair of arms being articulated to the centre of a piston, and also four other distinct arms, integral with the central shaft, connecting the central shaft to the articulation rollers and being of variable length radially. The transmission mechanism of this document indeed ensures a uniform rotation of the central shaft and, at the same time, a support of the pistons during the motor cycle, but at the risk of generating losses by friction at the level of the slides, whilst being cumbersome and of complex construction.

Furthermore, the document WO2004/070169 (G. Saint-Hilaire) proposes a solution of a transmission mechanism of the torque between the pistons of a rotary machine with a deformable rhomb and a central shaft thereof, in which the transmission mechanism takes up a smaller encumbrance.

The transmission mechanism comprises two power rings arranged axially, one in the extension of the other, to the centre of the rotor of the machine, each ring receiving the torque originating from two bearing rollers connected to two opposed pistons. The movement of each power ring is transmitted to a central shaft with a tangential differential formed of four curved washers mounted on a central shaft and the protuberances of which are inserted in slots of the power rings. Being, indeed, of a more compact construction than the mechanism of the preceding document, it must be acknowledged that the solution described in this document can only transmit low torques, whilst necessitating a good mastery of the functional clearances between the multiple parts in relative movement and that, due to the use of transfer protuberances, the lifespan of such a complex mechanism is very limited.

The document US2003/062020 (P. D. Okulov) describes a rotary machine with a deformable rhomb comprising four pistons connected with each other by an articulated parallelogram, which are caused to oscillate in rotation on their movement inside a housing of ovoidal shape. This document illustrates, in addition, several solutions of mechanisms for the transmission of the movement between the pistons and a central transmission shaft. Among these solutions, one is noted comprising a toothed wheel integral with a central shaft which is caused to mesh with pinions mounted in the centre of each piston. However, due to the variation in speed between the different pinions, these latter can not all be integral in rotation of the pistons. Thus, in the case where two pinions are integral in rotation of opposed pistons and the two others are free in rotation, the mechanism can not transmit a uniform rotation to the shaft, which therefore receives solely the torque originating from the two opposed pistons. In the case where a single pinion is integral with the piston and the three others are free in rotation, the torque which is often great in this type of machines is only transmitted by a single pinion, which could greatly damage its toothing. If two pinions of contiguous pistons are integral with the pistons, then the transmission can not function. Another solution describes a mechanism of the Maltese Cross type, mounted fixedly on the central shaft, and comprising slots in which rollers slide belonging to arms connecting each rotary articulation to the shaft. This mechanism indeed ensures a more uniform rotation of the central shaft, but at the cost of great friction in the slide connections of the slots of the device, which leads to losses in the transmission of the torque to the shaft.

OBJECT OF THE INVENTION

The aim of the invention is remedy the above-mentioned disadvantages and to propose a rotary machine with a deformable rhomb comprising a transmission mechanism able to transmit the rotation torque between the rhomb and the central or peripheral transmission shaft to the rhomb so as to ensure a uniform rotation speed of the transmission shaft.

Another aim of the invention is to propose a rotary machine with a deformable rhomb comprising a mechanism for transmission of the movement between the rhomb and the central or peripheral transmission shaft able to ensure a good efficiency of the transmission, whilst offering a reliable functioning and presenting an improved lifespan.

Another aim of the invention is to propose a rotary machine with a deformable rhomb with a reversible operation comprising a transmission mechanism able to transmit the rotation torque between the rhomb and the central or peripheral transmission shaft to the rhomb, for a uniform rotation speed of this shaft.

Another aim of the invention is to propose a rotary machine with a deformable rhomb comprising a mechanism for transmission of the movement between the rhomb and the central or peripheral transmission shaft of a simplified and compact structure, whilst being able to be realized in an economical manner.

These aims are achieved with a rotary machine with a deformable rhomb comprising:

a) a rotor which is a deformable rhomb which is directly or indirectly (by means of a joint or of the external surface of a pivotal hinge) in contact, with or without clearance, with the internal surface of a housing forming a stator and/or with the external surface of a central crown, the said deformable rhomb comprising four pistons connected, one following the other, by a pivotal hinge with an axis parallel to the longitudinal axis of the housing and thus forming a closed chain; and also b) a mechanism for transmission of the movement between the pistons and a rotation shaft coaxial to the central axis of the machine, the said machine being characterized in that the said transmission mechanism comprises:

- a first rolling body fixedly mounted on at least one piston, preferably on each piston, the axis of the said first rolling body passing in the centre of the piston
- a second rolling body, the centre of which passes through the central axis of the machine and is integral with the said rotation shaft
- the first rolling body being connected to the second rolling body directly or by a transmission member
- and that the gear ratio between the first and the second rolling body is equal to 2 and is positive.

The machine therefore comprises four articulated pistons forming a deformable rhomb, the deformation of the rhomb being able to take place when it turns inside a fixed housing surrounding the rhomb, or when it turns around a fixed central crown arranged inside the rhomb, or when the housing or the crown turns with respect to the rhomb fixed in rotation. The central axis of the machine is understood to mean the longitudinal rotation axis of the machine which is parallel to the directing line of the housing, the housing being generally symmetrical with respect to this longitudinal axis.

According to the invention, the machine comprises a transmission mechanism between the rhomb, in particular its pistons, and the rotation shaft of the machine. More particularly, the said mechanism comprises, for at least one piston, preferably for each piston, a first rolling body mounted in the centre of the piston which is in direct contact with, or which is connected by a transmission member to, a second rolling body integral with the rotation shaft of the machine. A rolling body is understood to mean a part of general cylindrical shape, which can be a cylinder or a portion of a cylinder. In a simplified version of the invention, the transmission mechanism can function with a single first rolling body mounted on a single piston, or with only two or three first rolling bodies mounted on respectively two or three pistons. This structural simplification presents an economical interest, because it allows the cost of realizing the transmission mechanism to be reduced. However, it is preferred to mount a rolling body on each piston so as to obtain a well-balanced transmission mechanism unit, with good guidance of the rotor for an improved lifespan of the machine.

In accordance with the invention also the first rolling body and the second rolling body are connected either by coming directly in contact, it being understood that the movement is transmitted directly from one rolling body to the other, for example by using an obstacle- or friction drive, or by an intermediate part, in particular by using a transmission member. A transmission member is understood to mean a device or part allowing the transmission of the torque and the rotation movement of the first rolling body, situated at a distance from the second rolling body. Such a transmission member between two rolling bodies can include an intermediate rolling body or a unit comprising intermediate rolling bodies. By way of example, this transmission member can be a chain, a belt, etc. Such an arrangement of rolling bodies is particularly advantageous because on deformation of the rhomb, the length of the medians of this rhomb does not change, one can therefore greatly simplify the design and the structure of the transmission mechanism.

In accordance with the invention also the gear ratio between the first and the second rolling body is positive and is equal to two. In fact, the arrangement of the transmission elements on a median must take into account the fact that the angle between the medians is variable with the deformation of the rhomb. Thus, the mechanism of the invention draws upon the use of a reducer on each median segment connecting the centre of a piston to the centre of the rhomb. This reducer utilizes a geometric property of the deformable rhomb implemented by the invention, which is the fact that, on deformation of the rhomb, the rotation angle of a median due to this deformation of the rhomb is half the angle comprised between the side of the rhomb and the median. The geometric principle on which the functioning of the transmission mechanism of the invention is based is better described below, in the detailed part of the description.

The transmission mechanism of the invention therefore allows both transmission of the rotation torque of the pistons around the centre of the machine and the tipping torque of the pistons around their centre to the rotation shaft in the motor or turbine mode and conversely, when the machine is functioning in the compressor or pump mode. A RMDR according to the invention can serve to pump, turbine, compress, expand, crush, dose, mix fluids, charged or not, by using means connecting it to a fluid circuit exterior to the machine, or else can be used in an internal combustion heat engine of a mixture of fuel and combustive-fuel.

The transmission mechanism of the invention therefore allows the correct transmission of the torque between each piston of the rhomb and the rotation shaft of the machine, whilst ensuring a uniform rotation speed of this shaft, this being within the framework of a construction which is simplified and efficient with regard to energy.

Preferably, the said first rolling body and the said second rolling body are provided with driving protuberances on at least a portion of their periphery.

Such a transmission member having driving protuberances forms a drive by contact and transmits the power by obstacles. This ensures a synchronous transmission of movement, therefore without sliding, which is silent and with a good yield of energy between each piston and the rotation shaft of the machine. Thus, when the pressure inside the chambers of the machine (chamber being understood to mean the volume comprised between the housing which surrounds the rhomb and the extrados face of a piston, or any other variable volume cavity arranged in the machine) is not homogeneous, or when the pistons are subject to reaction forces on contact with the guiding surface of the housing, or when they are subject to different dynamic effects due to the kinematics of the machine, the forces acting on a piston can create a tipping torque of the piston around its centre. This tipping torque of the pistons is transmitted to the rotation shaft via the driving protuberances.

Advantageously, the said transmission mechanism comprises gears with parallel axes and straight toothing.

The transmission mechanism of the invention therefore uses a mechanical system composed of toothed wheels serving for the transmission of the rotation movement. Gears with parallel axes and straight toothing are preferred because they offer a solution permitting a high-value torque transmission, without introducing axial forces, this being in an economical manner.

However, for embodiments of silent machines, preferably gears with parallel axes and helicoidal toothings will be preferred for the transmission mechanism of the invention. In this case, it is possible to compensate the axial forces by superimposing gears, the toothing angles of which are inverted.

In a preferred variant embodiment of the invention, the first rolling body is a half-pinion integral with a piston which meshes with a toothed wheel forming the second rolling body integral with the central rotation shaft of the machine with an intermediate rolling body forming a satellite pinion.

This solution permits an efficient transmission of the rotation movement between the pistons of the rhomb and a rotation shaft, ensuring a uniform rotation speed of the shaft situated in the centre of the machine, for a good yield of energy, whilst being able to be realized for a low cost.

In another variant of the invention, the said first rolling body is a conical pinion connected to the said second rolling body, which is a conical toothed wheel, by a shaft provided with conical pinions at the ends.

The transmission member between the first and the second rolling body is a shaft provided with conical pinions at each of its ends. The gear realized between this shaft and the first rolling body is able to be assimilated to a reducer with angle transmission. The same applies to the gear realized between this shaft and the second rolling body. The intermediate transmission member is a shaft with an axis arranged according to a radial direction (in the case of simple conical toothings), perpendicular to the longitudinal directions of the axes of the pinion (integral with the piston) and of the conical toothed wheel (integral with the rotation shaft). This embodiment in addition allows one to be free of the dimensional constraints of the rhomb, because the distance between the two conical pinions of the intermediate shaft is no longer linked to the dimensions of the toothing and can therefore readily vary. This solution allows machines having very large dimensions to be realized, with a transmission which remains rigid, light and compact.

In another advantageous variant embodiment of the invention, the said first rolling body is a toothed circular sector fixed on a piston which meshes with a toothed peripheral crown with interior toothing, integral with the rotation shaft.

This solution permits a driving by direct meshing between the pistons of the rhomb and a peripheral crown offering a positive gear ratio, without the need to adjoin intermediate satellite pinions. Furthermore, a drive by toothed crown with interior toothing has a larger diameter, with more teeth in contact and can therefore transmit a greater torque.

Preferably, the toothed crown presents a cylindrical peripheral contour and the toothed sectors are arranged with one in the extension of the other so that they form an internal crown which is deformable in width (in the radial direction) greater than that of a chamber of the machine, so as to close these variable volume chambers. The cylindrical peripheral contour of the toothed crown promotes the transmission of the rotation movement and the integration of the machine.

By making the toothed sectors integral with the pistons, the lateral face of which is placed towards the interior of the machine, this allows the external chamber of the machine to be closed, this being on the periphery of the housing.

Advantageously, the machine comprises an inner cavity to the rhomb intended for the displacement of a fluid or to receive an element which is exterior to the machine.

Thus, by arranging the elements constituting the transmission mechanism on the external lateral sides of the pistons, the central space of the rhomb (space defined by the internal faces of the pistons, designated intrados faces) forms, on deformation of the rhomb, variable volume inner cavity. This inner cavity, cleared from the transmission mechanism, can therefore be used to realize a complementary function of the machine, such as that of pumping a fluid, indeed it can be used to receive other elements of the installation functioning with the machine of the invention to obtain still more compactness of the unit.

Advantageously, the transmission element can divide the space of the central cavity or of other cavities, provided that the transmission members which are used oppose a sufficient brake to the passage of the fluid. In fact, the transmission with gears is very close to the conditions for realizing geared pumps. Likewise, the transmissions with friction rollers are very close to lobe pumps without external synchronization.

The separations which are thus created serve to form several variable volume inner cavities intended to pump, compress, turbine or displace fluid, but also to amplify or not variations in volume, or to limit dead volumes.

In an advantageous embodiment of the transmission mechanism of the invention, the said first rolling body and the said second rolling body are connected by a chain or by a notched belt.

This solution offers a driving at a distance between the rolling bodies, without having recourse to intermediate rolling bodies, which principally presents the advantage of obtaining a transmission mechanism according to the invention which can be dimensioned such that it is independent of the interaxial distance between the first and the second rolling bodies. This can permit an adaptation more readily to an imposed dimension of the machine.

In another advantageous embodiment of the transmission mechanism of the invention, the said first rolling body is connected to the said second rolling body by a smooth belt. This variant embodiment of the transmission mechanism permits a facilitated installation and mounting in the interior of the machine, whilst offering the possibility of a fine adjustment of the angular positions of the components.

Preferably, the two first opposed rolling bodies are connected to the second rolling body by a shared chain or by a shared belt; or all the first rolling bodies are connected to the second rolling body by a shared belt or by a shared chain.

A simplified construction of the transmission mechanism can thus be obtained, whilst being able to transmit more torque between the pistons and the rotation shaft of the machine.

Advantageously, the said first rolling body and the said second rolling body are friction rollers, being able to each comprise a hard core covered by a flexible casing.

Such a transmission mechanism with friction rollers, being able to each comprise a hard core covered by a flexible adherent casing is desirable for applications requiring a transmission with low torques, but with greater requirements for uniformity of transmission and of the absence of operating noise thereof.

Preferably, the said first rolling body is connected by at least one intermediate rolling body to the said second rolling body.

This allows a transmission to be realized by rigid rolling contact, with the intermediate rolling body permitting a positive speed ratio to be retained or obtained.

Advantageously, two opposed pistons are connected together by at least one median arm, each of the ends of the said median arm being pivotably mounted in the centre of each piston. By imposing a value of the clearance in the pivotal hinges of the median arms which is less than that of the clearance in the articulations of the pistons, these median arms therefore allow the bearing of the radial forces acting on the pistons and allow the good functioning of the transmission mechanisms to be ensured.

Advantageously, the transmission mechanism has a reversible operation.

Certainly, one would have been able to use a mechanism for transmission of the movement between the pistons and a rotation arm in a single direction, for example by using a unit of the type with a toothed wheel and an endless screw. However, it is preferred to use a mechanism where the transmission of the movement can be carried out of the pistons towards the rotation shaft and vice versa, because this permits a reversible functioning of the machine. Furthermore, the low reduction ratio between the first rolling body and the second rolling body facilitates the use of reversible mechanisms.

Preferably, the piston and the said first rolling body form a single-piece part. This solution is preferred, because it ensures greater ease in mounting the transmission mechanism within the machine, and also when the pistons are subject to high stresses.

Advantageously, the transmission mechanism allows an inner cavity of the machine to be separated into one or several variable volume cavities.

Thus, by arranging the transmission mechanism in an inner cavity of the machine, and when the transmission between the piston and the central rotation shaft is carried out with gears or friction rollers, these elements of the transmission mechanism permit the inner cavity of larger volume to be divided into one or several cavities of smaller volume, the volume being variable with the deformation of the rhomb. By carrying out the arrangements ensuring the tightness in the interior of one or of these chambers and in branching it or them to one or several fluid circuits, this permits a supplementary function to be assigned, for example that of a pump, to this or these variable volume cavities which are thus obtained.

DESCRIPTION OF THE FIGURES

FIGS. 3 to 9 illustrate different variants of a transmission mechanism according to a first embodiment of the invention, in which:

FIG. 11*c* is a perspective view of the machine of FIG. 11*b* and FIG. 11*d* is a view in longitudinal section of the machine of FIG. 11*c*.

LIST OF REFERENCE NUMBERS

Figure 1:
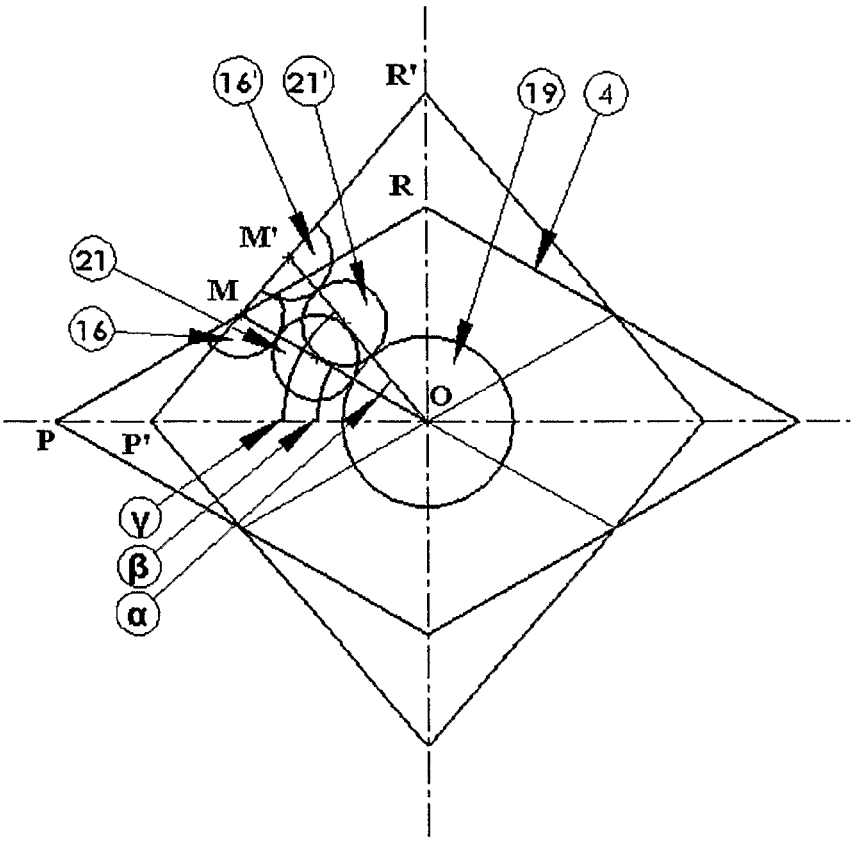
FIG. 1 illustrates a diagrammatic view illustrating the principle on which the invention is based.

| | |
|---|---|
| 1 | housing |
| 2 | Stator |
| 3 | rotor |
| 4 | deformable rhomb |
| 5 | summit of the rhomb |
| 6 | piston |
| 7 | pivotal hinge (pivot) |
| 8 | external cavity |
| 9 | extrados face |
| 10 | inner cavity |

-continued

| | |
|---|---|
| 10a, 10b, 10c, 10d | variable-volume cavities |
| 11 | intrados face |
| 12 | fluid inlet orifice |
| 13 | fluid outlet orifice |
| 14 | transmission mechanism |
| 15 | rotation shaft |
| 16, 16' | first rolling body |
| 17 | first rolling body axis |
| 18 | intermediate transmission member |
| 19 | second rolling body |
| 20 | centre of the second rolling body |
| 21, 21' | intermediate rolling body |
| 22 | cotter |
| 23 | median arm |
| 24 | median arm |
| 25 | clearance |
| 26 | central orifice |
| 27 | upper end |
| 28 | lower end |
| 29 | upper axis |
| 30 | lower axis |
| 31, 31', 31'', 31''' | support axis |
| 32 | chain |
| 33, 33' | shared chain, shared belt |
| 34 | notched belt |
| 35 | smooth belt |
| 36 | half-roller |
| 37 | central roller |
| 38 | intermediate roller |
| 39 | toothed circular sector |
| 40 | toothed crown |
| 41 | peripheral contour |
| 42 | deformable internal crown |
| 43 | central axis |
| 44 | protuberance |
| 45 | hollow zone |
| 46 | lightening groove |
| 47 | half-pinion |
| 48 | satellite pinion |
| 49 | toothed wheel |
| 50 | compressor |
| 51 | tensioner |
| 52 | central cavity |
| 53 | conical half-pinion |
| 54 | conical toothed wheel |
| 55 | intermediate shaft |
| 56 | upper conical pinion |
| 57 | lower conical pinion |

DETAILED DESCRIPTION OF THE INVENTION

The invention concerns a rotary machine with a deformable rhomb (RMDR) being able for example to function as a motor or as a compressor. The machine comprises, as better visible in FIG. 3*d*, a stator 2 having a general tubular shape of approximately oval section, the profile of which is consistent with the geometric rules imposed by the deformation of the rhomb during its rotation, and the internal surface of which defines a housing 1 for receiving a rotor 3 which is a deformable rhomb 4. The deformable rhomb 4 is an assembly of four pistons 6 connected with each other by pivot connections, formed by pivotal hinges 7, and which form a chain which is closed within itself. The rotor 3, which is the turning part of the machine, is generally the rhomb 4, but one may, in a variant, drive the housing 1 in rotation which then turns with respect to the rhomb 4, which is fixed in rotation, but the sides of which deform (side is understood to mean the segment which connects, in a plane perpendicular to the rotation axis of the machine, the axes of two adjacent pivot connections). The projections of the axes of pivot connections of the pistons in a plane perpendicular to the rotation axis of the machine represent the summits 5 (FIG. 2) of the rhomb 4. In a variant which is not shown in the figures, the deformation of the rhomb 4 can also take place by guidance around a central crown, fixed or movable in rotation, arranged in the interior of the rhomb and the profile of which is consistent with the geometric rules imposed by the deformation of the rhomb.

A piston 6 is a part having a shape of a cylinder portion with a directing line parallel to the rotation axis of the machine. The surfaces situated at the two ends of this part each ensure a part of a pivot connection with a rotation axis parallel to the rotation axis of the machine. The segment which connects two median points of the opposite sides of the rhomb, in particular of two opposed pistons, forms a median of the rhomb. The segment which connects two opposed summits 5 forms a diagonal of the rhomb. The centre of the pistons is the middle of a side of the rhomb, it is the junction point with the medians of the rhomb. The intersection of the diagonals or medians of the rhomb defines the centre of the machine through which the central axis of the machine passes. Rotation shaft 15 of the machine is understood to mean a part or an assembly of mechanical parts allowing the rotation movement of the rotor or of the stator to be recovered or imposed via a suitable mechanical transmission system 14.

The machine also comprises two lateral closure flanges (not represented in the figures), arranged perpendicularly to the rotation shaft of the machine and which rest against the front and rear faces of the stator 2 and of the rotor 3.

Figure 3A:
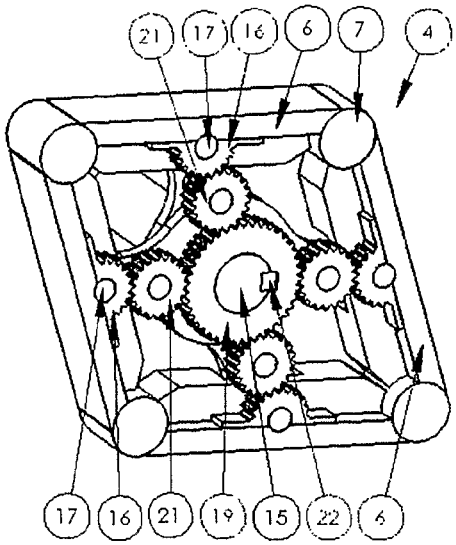
FIG. 3*a* is a view in transverse section illustrated in perspective of the internal part of a machine comprising a transmission mechanism according to a first variant embodiment.
Figure 3B:
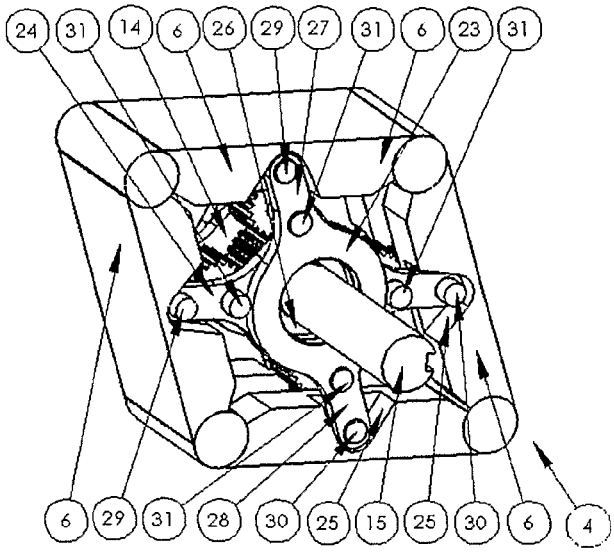
FIG. 3*b* is a perspective view of the machine of FIG. 3*a*.
Figure 3C:
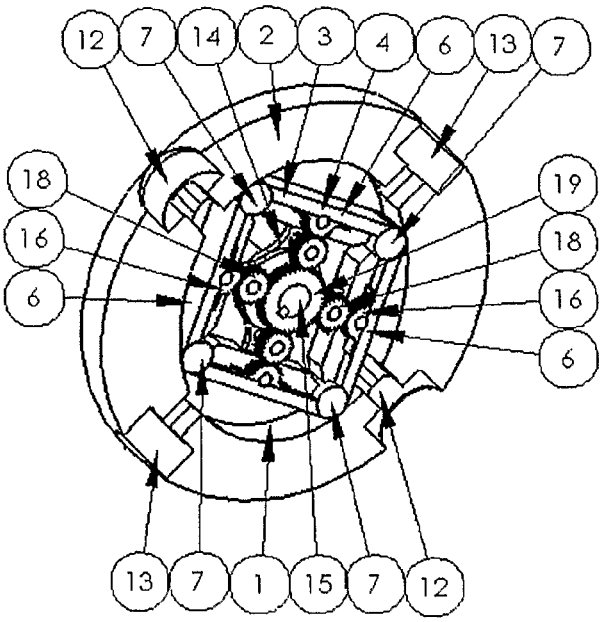
FIG. 3*c* is a perspective view of a machine of FIG. 3*a* completed by a stator.
Figure 3D:
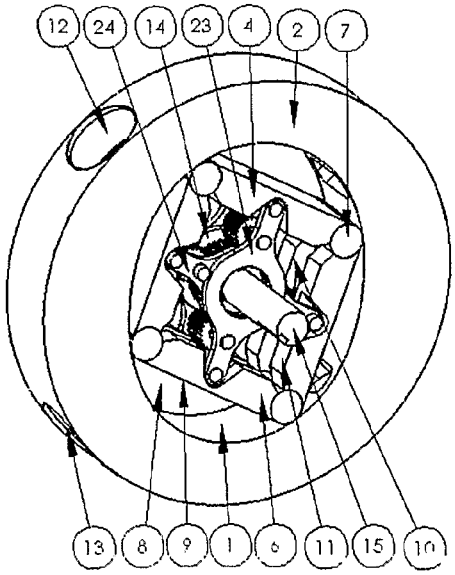
FIG. 3*d* is a perspective view of a machine of FIG. 3*b* completed by a stator.

The extrados face 9 of the piston 6 will be understood below to mean the external surface of the piston 6, situated on the exterior of the rhomb 4, and the intrados face 11 of the piston 6 will be understood to mean the internal surface of the piston 6, situated in the interior of the rhomb 4 (FIG. 3*d*). The extrados face 9 of a piston 6 defines with the housing 1 and the lateral closure flanges an external cavity 8. Two fluid inlet orifices 12 and two fluid outlet orifices 13 are, in the examples shown in FIGS. 3*c*, 3*d*, 11*c*, 12*a*, 12*b* and 12*c*) radial ducts formed through the housing 1 and permitting an exchange of fluid between the external cavities 8 and a fluid circuit exterior to the machine.

A fluid circuit is connected to the machine, the entry in the external chambers 8 being illustrated, by way of example, by an orifice 12 in communication with the entry or upstream circuit of the machine, and the exit of fluid being illustrated, by way of example, by an orifice 13 which itself is in communication with an exit or downstream circuit of the machine.

The intrados faces 11 of the pistons 6 (FIG. 3*d*) define, with their connecting articulations 7 and with the lateral closure flanges, a variable-volume inner cavity 10.

According to the invention, the machine comprises a transmission mechanism 14 of the movement between the pistons 6 and a rotation shaft 15 coaxial to the central axis of the machine, due to the fact that the said transmission mechanism 14 comprises, for each piston 6, a first rolling body 16 mounted fixedly on the piston 6, the axis 17 of the said first rolling body passing in the centre of the piston 6, the first rolling body 16 being connected to the second rolling body 19 directly or by means of an intermediate transmission member 18 (FIG. 2) so as to transmit the rotation movement originating from the said first rolling body 16 to the second rolling body 19 (FIG. 3*a*), the centre 20 of which (FIG. 2) passes through the central axis of the machine and is integral with the said rotation shaft 15, and where the gear ratio between the first 16 and the second rolling body 19 is equal to 2 and is positive.

FIG. 1 illustrates the geometric principle which is the basis of the design of the transmission mechanism of the invention. The deformable rhomb 4 is represented diagrammatically in two operating positions of the machine, on the rotation of the rhomb about its centre O, a side PR of the rhomb in the first position taking the position P'R' in the second position. It demonstrates that when the median OM turns by an angle a to reach the position OM', the angle OMR between the side of the rhomb and the median varies by an angle 2*a* to reach the position OM'R'.

FIG. 1 shows that:

$$\widehat{MOM'} = \alpha = \gamma - \beta \quad (1)$$

$$\widehat{OMR} = \pi - 2*(\pi/2 - \beta) \text{ as OMR is an isosceles triangle.} \quad (2)$$

$$\widehat{OM'R'} = \pi - 2*(\pi/2 - \gamma) \text{ as OM'R' is an isosceles triangle.} \quad (3)$$

From relations (2) and (3) it is taken that:

$$\widehat{OM'R'} - \widehat{OMR} = 2*(\pi/2 - \beta) - 2*(\pi/2 - \gamma) = 2*(\gamma - \beta) \quad (4)$$

From relations (4) and (1) it is obtained that:

$$\widehat{OM'R'} - \widehat{OMR} = = 2*(\gamma - \beta) = 2*\alpha = 2*\widehat{MOM'} \quad (5)$$

Thus, the above geometric relations which are derived in association with FIG. 1 demonstrate that, when the median (represented by the segment OM) turns, with respect to the diagonals, by an angle a, the angle between the side of the rhomb (represented by the segment PR) and the median varies by 2*a*.

The geometry of the rhomb therefore imposes that the rotation speed of a side of the rhomb (represented here by the segment PR) with respect to its median (represented by the segment OM) which connects, it to the centre of the machine (O), over the rotation speed of this median (OM) is two and is positive.

The rolling bodies 16, 19, which can be in a variant gears composed of pinions with exterior toothing, invert the direction of rotation. In this case, an intermediate body 21 is used, forming a satellite pinion, which essentially serves to retain a positive speed ratio. The rolling bodies 16, 21 arranged according to the median OM in the first position of the rhomb 4, take the references 16', 21', being arranged according to the median OM' in the second position of the said rhomb.

The primitive diameter ratio between the pinion of the piston and the pinion of the rotation shaft is 2 to comply with the geometric rule linked to the geometry of the deformable rhomb.

Figure 2:
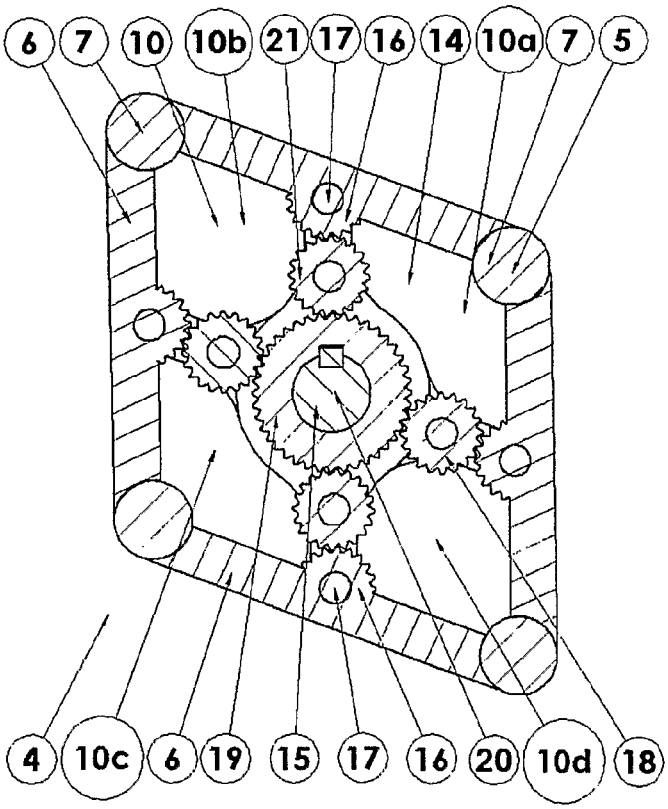
FIG. 2 illustrates a view in transverse section of the internal part of the machine comprising a transmission mechanism realized according to the invention.

An example of putting into practice the above-mentioned principle is better visible in FIG. 2 where the first 16 and the second rolling bodies 19, and also the intermediate rolling bodies 21 are provided with teeth on their periphery, which means that the intermediate transmission member 18 is a geared device.

In a first variant of a first embodiment, as can be seen in FIGS. 3*a* to 3*d*, the first rolling body 16 is a half-pinion integral with an axis 17 which is mounted fixedly in the centre of a piston 6, its toothing being oriented towards the centre of the rhomb 4. In a preferred variant embodiment (FIG. 2), the half-pinion constituting the first rolling body 16 and the piston 6 are realized in a single piece, advantageously realized by a process of cutting by electroerosion wire in a block of isotropic material for small series or by sintering for large series. When the first rolling body 16 is a block added on the piston 6, it is then possible to put in place a mechanism of angular staggering between the added block and the piston, so as to compensate for the clearance which is able to exist in the gears of the transmission 14. Conversely, when the first rolling body 16 and the piston 6 are single pieces, the second rolling body 19 or the intermediate transmission members 18 must be capable of compensating for the angular clearance existing in a gear assembly. In this latter case, it is possible to use clearance adjustment pinions. By, way of example, the half-pinion of the first rolling body preferably comprises between 20 and 40 teeth, uniformly distributed over the entire periphery, namely between 10 and 20 for the half-pinion as shown in the figures. Only certain teeth are useful, according to the degree of deformation of the rhomb.

The second rolling body 19 is a toothed wheel, made integral in rotation with the rotation shaft 15 passing in the centre of the rhomb 4, for example by fixing it to the latter with a cotter 22. The second rolling body 19 is a toothed wheel comprising a number of teeth equal to twice the number of teeth of the first rolling body 16 or half-pinion, and preferably comprised between 40 and 80, uniformly distributed over the periphery, but where only certain teeth are useful, according to the degree of deformation of the rhomb.

The intermediate rolling bodies 21 are satellite pinions having the same module as the half-pinions and the toothed wheel and which serve to invert the rotation direction between the half-pinions and the toothed wheel. Their diameter, respectively their number of teeth, are selected as a function of the occupied space of the machine, in particular according to the dimensions of the rhomb 4.

As is better visible in FIGS. 3*b* and 3*d*, two opposed pistons 6 are connected together by a median arm 23, and the two other opposed pistons 6 of the rhomb 4 are connected together by another median arm 24, where each of the ends of the median arms 23, 24 is mounted pivotably in the centre of each piston 6. The median arms 23, 24 are disposed in pairs, one behind the other at each front end of the rhomb 4. More particularly, with reference to FIG. 3*b*, a median arm 23, 24 is a piece of generally oblong shape, comprising a central prominent part extending, on either side, by two elongated ends, upper 27 and lower 28. The protuberance has a central orifice 26 through which the central shaft 15 passes with or without clearance. Each end 27, 28 is mounted pivotably about an upper pivoting axis 29 or respectively lower pivoting axis 30, passing through the centre of each piston 6. A flared clearance 25 is arranged in the intrados face of the piston 6 and around each axis 29, 30 to permit the displacement in pivoting of each median arm 23, 24. Each median arm 23, 24 carries a support axis 31 on which the intermediate rolling body 21 is mounted, forming a satellite pinion. Each satellite pinion is mounted on the median arm which connects two opposed pistons. Thus, a satellite only turns on its axis when the piston turns around its centre (middle of a side of the rhomb). When the rhomb 4 turns in the housing 1, even without deformation of the rhomb 4, the satellites transmit this rotation to the rotation shaft 15 and, reciprocally, the rotation of the rotation shaft 15 drives the rhomb 4 in movement.

The half-pinions, the satellite pinions and the toothed wheel are selected from the straight gears with straight toothing for their good performance, for the low cost of this type of standard components, and due to the absence of axial forces and in particular when the constraints of noise pollution are low. In an advantageous embodiment, helicoidal toothings are preferred, which ensure a progressive contact, hence a more regular and less noisy operation. It is possible to compensate for the axial forces generated by the helicoidal pinions by putting in place two helicoidal pinions superimposed by a contrary helix angle.

It is also preferred to place in contact pinions of a same module, and to select a primitive diameter of the satellite pinions which is close to the primitive diameter of the piston pinions, so as to optimize their resistance to wear. Furthermore, so as to optimize the performance of the transmission, to increase the value of the transmissible torque and to reduce the wear of the gears, maximum primitive diameters are selected, these being limited by the occupied space of the rhomb 4. It is possible, in a variant embodiment (not illustrated in the figures), to use satellite pinions which are each composed of two superimposed pinions. In another variant embodiment (not illustrated in the figures), it is possible to stagger the rotation axis of the satellite pinions with respect to the medians of the rhomb. The gears of the invention are dimensioned so as to take into account the specific stresses to which they are subjected, in particular due to the facts that all the teeth do not operate, that the teeth which operate are principally stressed in flexion in the two orthoradial directions, and in a different manner, and that the contact pressures are not regular in the course of the cycle. Thus it is preferable, in the design of the mechanism and the dimensioning of the pinions, to take into consideration the most demanding cases of operation (irregularities, impacts, vibrations, oscillations), and to relate to the lifespan (number of cycles undergone) of each tooth.

In a variant (not illustrated in the figures), to take different toothing modules and to be free of geometric constraints, it is also possible to realize an intermediate body 21 composed of two superimposed toothings, the first toothing of which meshes on the first rolling body 16 and the second toothing of which meshes on the second rolling body 19.

In a variant (not illustrated in the figures), the toothed wheel, the four half-pinions and the satellite pinions can only comprise teeth on a portion of their periphery at the level of their respective meshing, which offers more freedom in the choice of the pitch of their toothing.

Figure 4A:
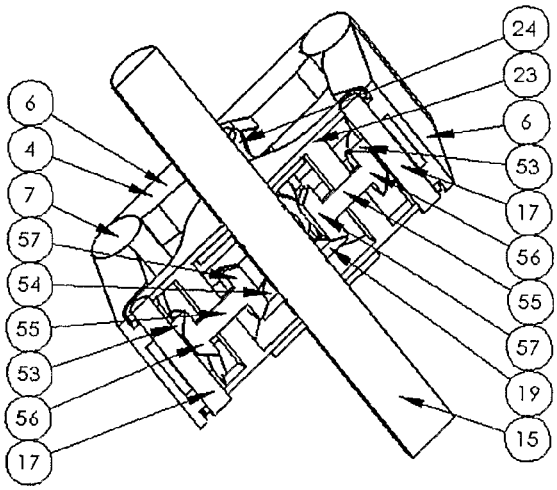
FIG. 4*a* is a view in section according to a plane containing the rotation axis and a median of the machine illustrated in perspective of the internal part of a machine comprising a transmission mechanism according to a second variant embodiment and FIG. 4*b* is a top view of the machine of FIG. 4*a* without the median arms.
Figure 4B:
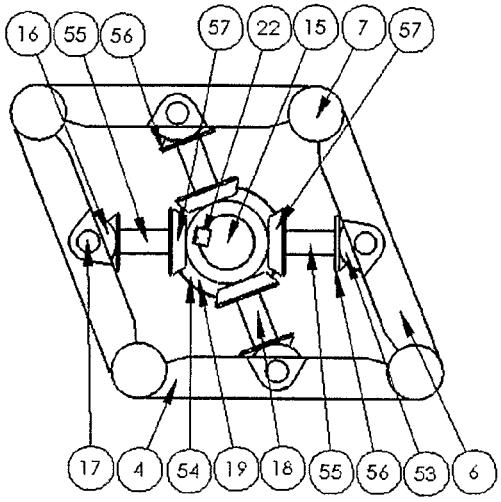

In a second variant embodiment presented in FIGS. 4*a* and 4*b*, the first rolling body 16 is a conical half-pinion 53 integral with a piston 6, and the second rolling body 19 is a conical toothed wheel 54 integral with the central rotation shaft of the machine. The toothings are not shown, for a better clarity of the figures, however the representation of the contact cones facilitates an understanding of the mechanism. The median arms have been omitted from FIG. 4*b*, so as to better see the internal elements. The intermediate transmission member 18 between the first rolling body 16 and the second rolling body 19 is an intermediate shaft 55 provided with conical pinions at each of its ends, in particular an upper conical pinion 56 and a lower conical pinion 57. The upper 56 and lower 57 end pinions are integral in rotation with the intermediate shaft 55, their axis being united with the axis of the intermediate shaft 55. When the conical gears of this embodiment use simple conical toothings, the axis of the intermediate shaft 55 is situated in a radial direction, according to the median which connects a piston 6 to the rotation shaft 15. The gearing realized between the intermediate shaft 55 and the first rolling body 16 or half-pinion 53 is able to be assimilated to a reducer with angle transmission. The same applies to the gearing realized between the intermediate shaft 55 and the second rolling body 19 or conical wheel 54. The speed ratio introduced by this gearing depends on the sizes selected to realize the reducers with angle transmission and, in accordance with the invention, it is 2:1. The conical half-pinion 53 and the upper conical pinion 56 mesh without reduction; they therefore have the same number of teeth and a simple straight toothing inclined at 45°. The lower conical pinion 57 and the conical toothed wheel 54 mesh with a reduction of ratio 2; the toothed conical wheel 54 therefore has a more open cone (approximately 127° against 53°) with twice as many teeth as the lower conical pinion 57. The speed ratio remains positive if the cones of the toothings of the first rolling body 16 or conical half-pinion 53 and of the second rolling body 19 or conical toothed wheel 54 point in opposite directions.

This variant embodiment presents the advantage of becoming free of the space constraints in the interior of the rhomb 4, because the distance between the two conical pinions 56, 57 of the intermediate shaft 55 is not linked to the toothing and can therefore readily vary. More particularly in the case of machines which have very large dimensions, this variant embodiment presents the advantage of a transmission which is simple (without tensioner rollers), rigid but light, owing to the hollow intermediate shafts with large exterior diameter, and finally which takes up far less space than a machine in which the transmission mechanism would comprise large toothed wheels.

In a variant embodiment which is not illustrated in the figures, it is possible to stagger or incline the rotation axis of the intermediate shaft 55, taking complex conical toothings.

The transmission mechanism 14 illustrated in the attached figures is a mechanism with reversible operation which ensures a reversible operation of the machine of the invention. The reduction ratio of 2 between the first rolling bodies 16 and the second rolling body 19 permits the use of reversible mechanisms. In fact, for all the embodiments and variants presented in this document, it is possible to dimension the rolling bodies 16 and 19, and also the intermediate transmission members 18, with toothing ratios, toothing angles, materials and clearances which make their operation reversible. Thus, the whole of the transmission 14 is perfectly reversible.

The median arms 23, 24 serve essentially as support to the intermediate rolling bodies 21, or to the tensioners 51, or to the idlers not shown in the figures. With the use of intermediate rolling bodies 21, the median arms 23, 24 also have the role of protecting the gears of the transmission mechanism 14 against the radial forces which act on the pistons 6. In fact, by choosing an optimum clearance at the level of their pivotal hinges around the axes 29, 30, less than that of the pivotal hinges 7, the median arms 23, 24 enclose the radial forces and allow the gears to function correctly. In a variant which is not illustrated, revolution cylinders can be adjoined to the toothed wheels and to the toothed sectors, so that these cylinders rest one against the other to prevent the toothings from being subjected to radial forces. However, the contact pressures generated between these cylinders (cylinder against cylinder) are greater than those brought about by the median arms 23, 24 (cylinder in bore).

Figure 5A:
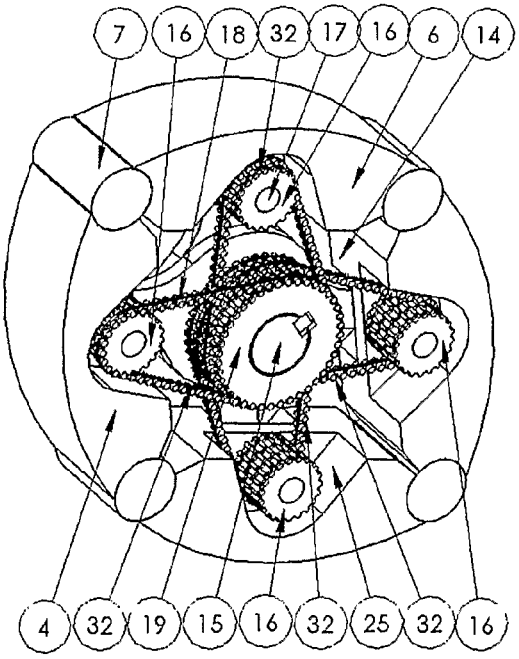
FIG. 5*a* is a view in transverse section illustrated in perspective of the internal part of a machine comprising a transmission mechanism according to a third variant of the invention and FIG. 5*b* is a perspective view of the machine of FIG. 5*a;*
Figure 5B:
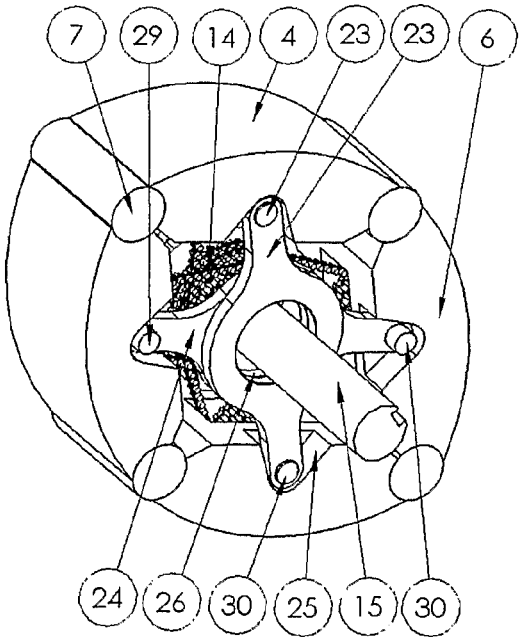

FIGS. 5*a* and 5*b* illustrate a machine realized according to a third variant, in which the first rolling body 16 is a toothed wheel integral with the piston 6, the second rolling body 19 is a toothed wheel integral with the rotation shaft 15 and in which the intermediate transmission member 18 is a chain 32 connecting the two rolling bodies 16, 19. The toothed wheels have, in a generally known manner, a toothing which is adapted to driving by a chain. The transmission mechanism 14 of the machine therefore uses four chains 32 connecting the four toothed wheels of the pistons 6 to a central toothed wheel integral with the rotation shaft 15. As in the preceding variants, the machine uses two median arms 23,24 mounted so as to be pivotably articulated around end axes 29, 30 each passing in the centre of a piston 6, the central orifice 26 of each median arm 23, 24 being passed through with clearance by the rotation shaft 15. The transmission mechanism 14 uses, in a manner known in transmissions with chains, a system of tensioning the chain (not shown in the figures) which advantageously rests on the median arms 23, 24, with the functioning clearance of the said system being predefined as a function of the technical specifications of the application (torque transmitted, speed, size of the links etc.).

The advantages of such a transmission mechanism 14 by chain 32 lie principally in the fact that one can be free of the use of the intermediate rolling bodies 21, 21', which principally presents the advantage of obtaining a transmission mechanism according to the invention which is independent of the interaxial distance between the first and the second rolling bodies. This can allow an adaption more readily to an imposed dimension of the machine. For small interaxial distances, it is therefore possible to increase the diameter of the first and second rolling bodies and also the pitch of the teeth (within the limit of possibilities of integration of the first rolling body on a small-sized piston). For large interaxial distances, on the contrary, these diameters of the first and second rolling bodies will be limited with respect to a variant which would use intermediate rolling bodies. This permits in particular the realization of a machine having large dimensions, turning at a greater speed, whilst limiting the dynamic and mechanical effects due to the inertia and to the moments of inertia of the intermediate rolling bodies 21 turning at high speed and in an irregular manner owing to a combination of rotation movements.

Figure 6A:
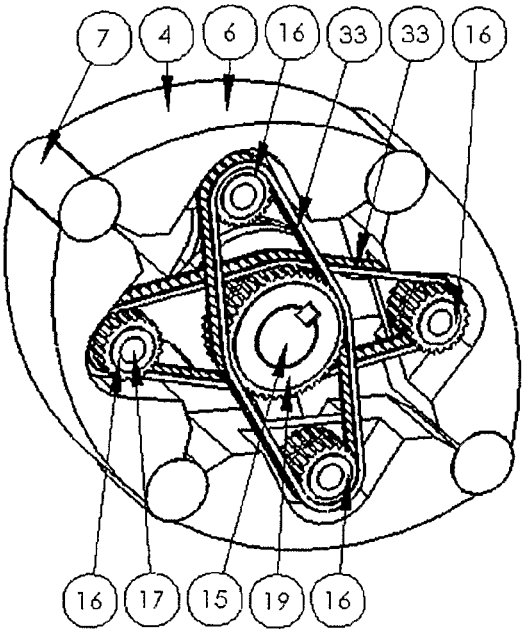
FIG. 6*a* is a view in transverse section illustrated in perspective of the internal part of a machine comprising a transmission mechanism according to a fourth variant of the invention and FIG. 6*b* is a perspective view of the machine of FIG. 6*a*.
Figure 6B:
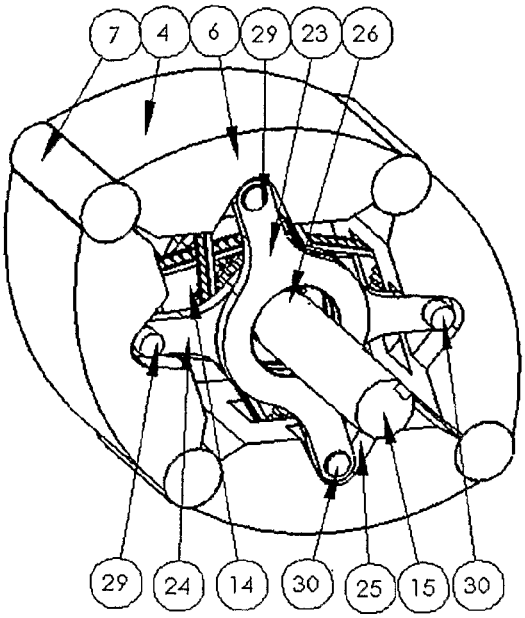

FIGS. 6*a* and 6*b* illustrate a transmission mechanism 14 realized according to a fourth variant of the first mode which differs from the above-mentioned third variant (FIGS. 5*a* and 5*b*) in that two first opposed rolling bodies 16 (where one rolling body 16 is integral in its centre with the centre of a piston and the other with the centre of the opposed piston) are connected together and are connected to the second rolling body 19 by a shared chain 33. This solution presents the advantage of being of a simplified design, whilst permitting the transmission of a greater torque between the pistons 6 and the rotation shaft 15, because the width of the chain can be doubled.

Figure 6C:
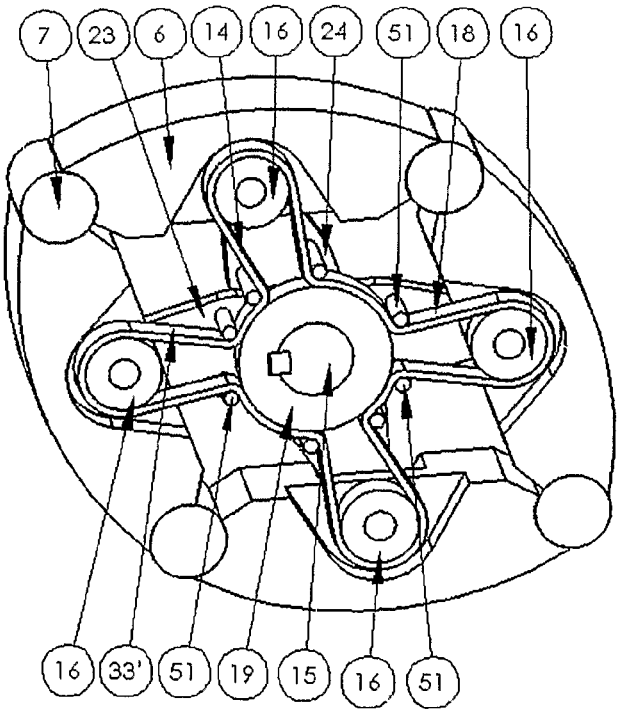
FIG. 6*c* is a view in transverse section illustrated in perspective of the internal part of a machine comprising a transmission mechanism according to another variant embodiment derived from that of FIG. 6*a;*

FIG. 6*c* illustrates another variant embodiment of the transmission mechanism 14 of the invention, in which all the first rolling bodies 16 are connected to the second rolling body 19 by a shared belt 33'. Tensioners 51 are provided for putting in contact the shared belt 33' with the periphery of the second rolling body 19, in particular two tensioners 51 delimit the contact portion of the belt 33' with the body 19. The axes of the eight tensioners 51 which the machine comprises are supported, for example, by median arms 23 and 24. This solution has the advantage of permitting the transmission of a torque which is even greater than in the embodiment of FIGS. 6*a* and 6*b*.

Figure 7A:
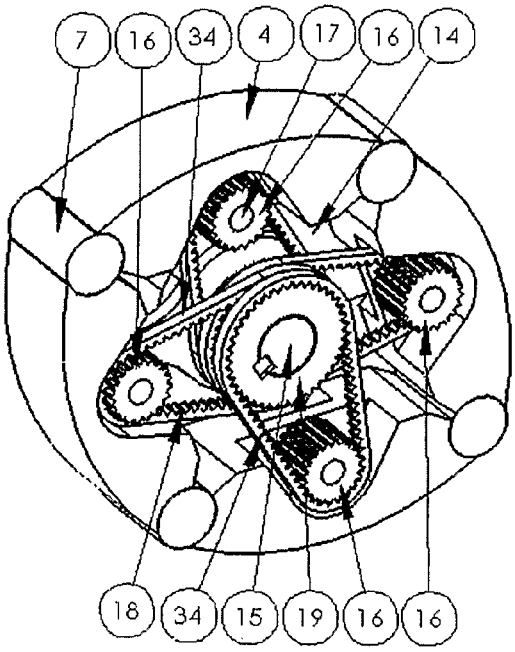
FIG. 7*a* is a view in transverse section illustrated in perspective of the internal part of a machine comprising a transmission mechanism according to a fifth variant of the invention and FIG. 7*b* is a perspective view of the machine of FIG. 7*a;*
Figure 7B:
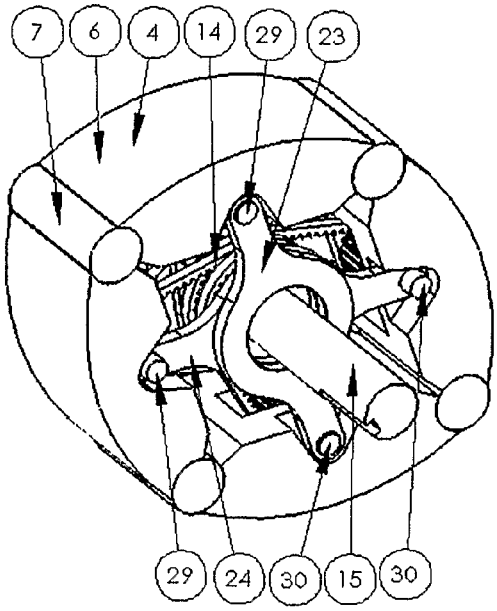

FIGS. 7*a* and 7*b* illustrate a transmission mechanism 14 realized according to a fifth variant of the first mode which differs from the above-mentioned third variant (FIGS. 5*a* and 5*b*) in that the intermediate transmission member 18 here is a notched belt 34. Thus, the first rolling body 16 is a toothed wheel integral with the piston 6, the second rolling body 19 is a toothed wheel integral with the rotation shaft 15, the movement between the two wheels being transmitted by a notched belt 34. Such a notched belt is made from a flexible material, for example an elastomer reinforced with fibers. The advantage of such a solution is that it is less noisy in operation than a chain, that the notched belt is lighter than a chain, whilst presenting a more regular operation. Thus, it is applicable more particularly to rapid and silent machines, but operating at lower pressures, for example less than 30 bar, in which the flexibility introduced in operation by the notched belt is not a hindrance. A notched belt is a synchronous belt; it ensures a transmission without sliding or without phase shifting between the entry and the exit.

Figure 8A:
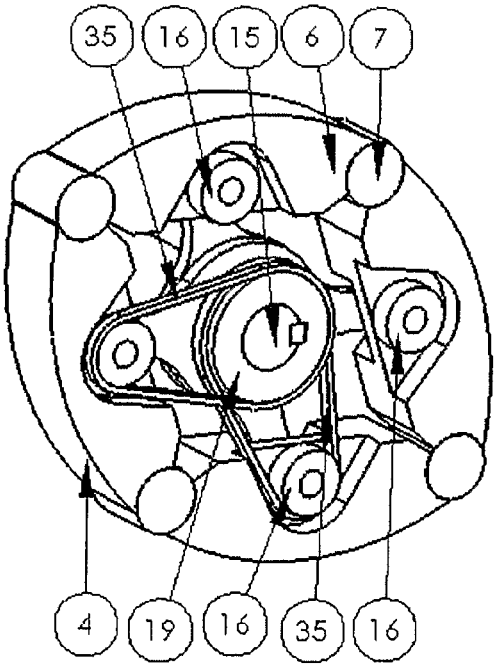
FIG. 8*a* is a view in transverse section illustrated in perspective of the internal part of a machine comprising a transmission mechanism according to a sixth variant of the invention and FIG. 8*b* is a view in transverse section illustrated in perspective of the machine of FIG. 8*a*, according to a section plane representing the whole of the transmission, mechanism.
Figure 8B:
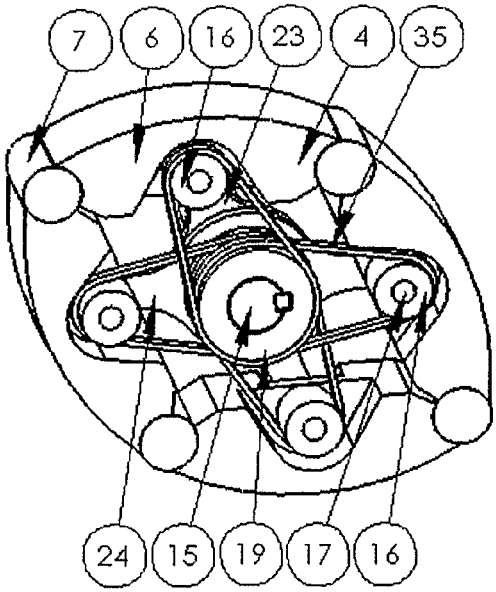

FIGS. 8*a* and 8*b* illustrate a sixth variant of the embodiment of the transmission mechanism 14 of the invention in which the first rolling body 16 and the second rolling body 19 are pulleys connected by a smooth belt 35. A tensioner roller (not illustrated in the drawings) can be provided on the median arms 23, 24 to adjust the tension of the belt when the latter is of the flat belt type with driving by adherence. The advantage of such a solution is that the smooth belt 35 simpler to put in place and that the angular positions between the first rolling body 16 and the second rolling body 19 can be adjusted more finely on mounting, because there are no notches to be followed and hence no staggering mechanism to be implemented. Furthermore, a possible sliding can occur in operation and result in a desynchronization between the first rolling body 16 and the second rolling body 19. However, this disadvantage can be compensated for by using a guiding device of the rhomb 4 formed by the articulated pistons, which means that the sliding of the smooth belt 35 permits an automatic resynchronization of the angles between the first rolling body 16 and the second rolling body 19.

In another variant, one could use a trapezoidal belt with driving by wedging, hence with less sliding.

Figure 9A:
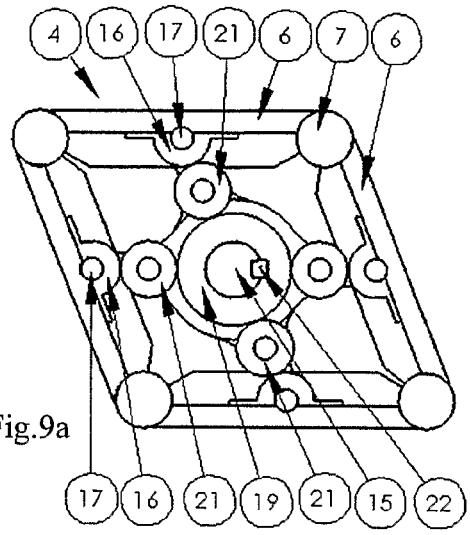
FIG. 9*a* is a view in plane transverse section and FIG. 9*b* is a view in transverse section illustrated in perspective of the internal part of a machine comprising a transmission mechanism according to a seventh variant of the invention.
Figure 9B:
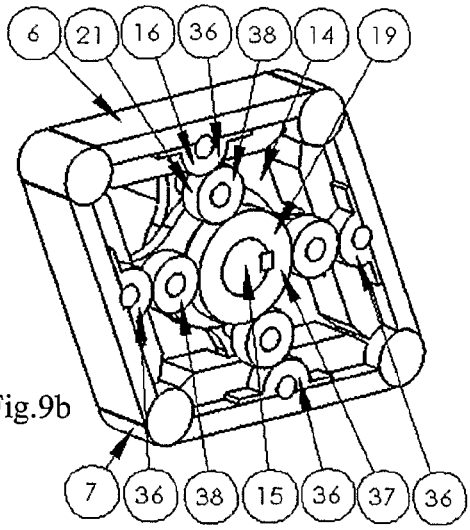
Figure 9C:
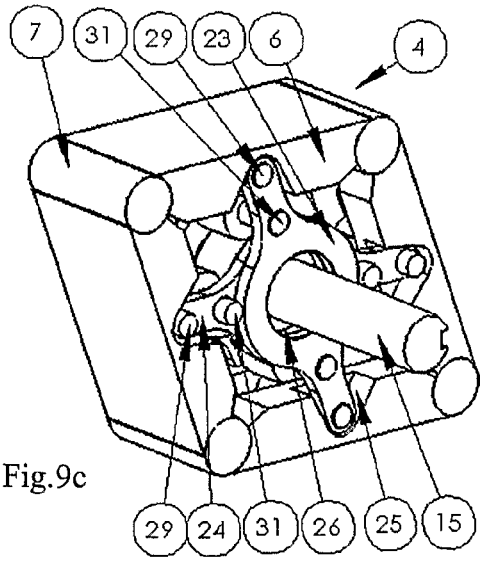
FIG. 9*c* being a perspective view of the machine of FIG. 9*b;*

FIGS. 9*a* to 9*c* illustrate a transmission mechanism 14 realized according to a seventh variant of the first embodiment. According to this variant, the first rolling body 16 and the second rolling body 19 are friction rollers; an intermediate rolling body 21 is also provided between the two rolling bodies 16 and 19. Apart from the transmission by friction and not by gears, the structure of the mechanism 14 according to this variant is quite close to that described with reference to FIGS. 3*a* to 3*d*; the reference numbers having the same role have been partly repeated in FIGS. 9*a* to 9*e*. The friction rollers have a metallic core and are covered on the surface by a casing of elastomer with a high coefficient of friction. To comply with the positive gear ratio, equal to two, the diameter of the central roller 37 mounted fixed in rotation on the rotation shaft 15 is equal to twice the diameter of a half-roller 36 integral with a piston 6. An intermediate roller 38 is dimensioned as a function of the occupied space of the rhomb 4. The transmission mechanism 14 realized according to this variant permits a driving by adherence, which is therefore subject to possible sliding, whilst being more rigid than a driving by a smooth belt 35.

In a variant (not shown in the figures), rollers can be used which are profiled or comprising spherical, cylindrical protuberances etc., which permits a driving without sliding between the pistons and the rotation shaft.

Figure 10A:
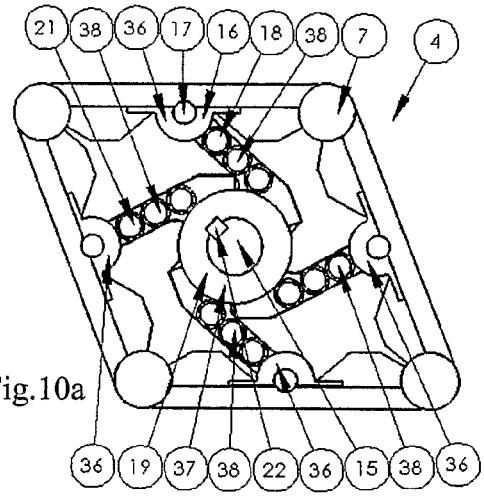
FIG. 10*a* is a view in plane transverse section and FIG. 10*b* is a view in transverse section illustrated in perspective of the internal part of a machine comprising a transmission mechanism according to an eighth variant of the invention, FIG. 10*c* being a perspective view of the machine of FIG. 10*b*.
Figure 10B:
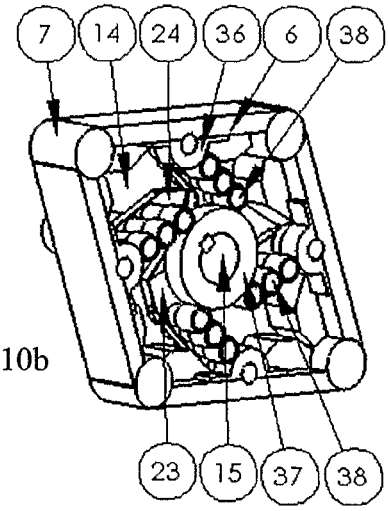
Figure 10C:
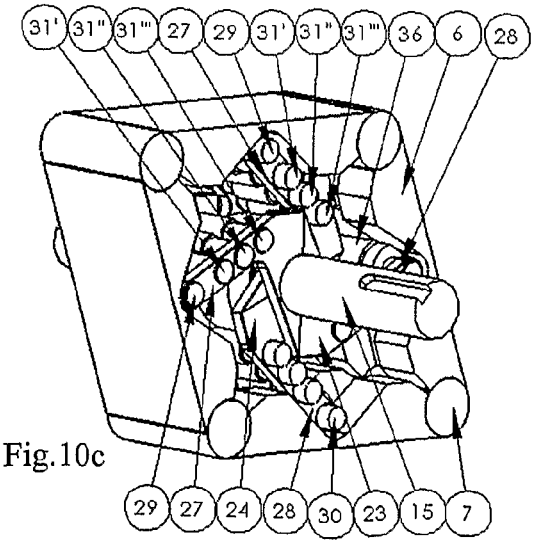
Figure 11A:
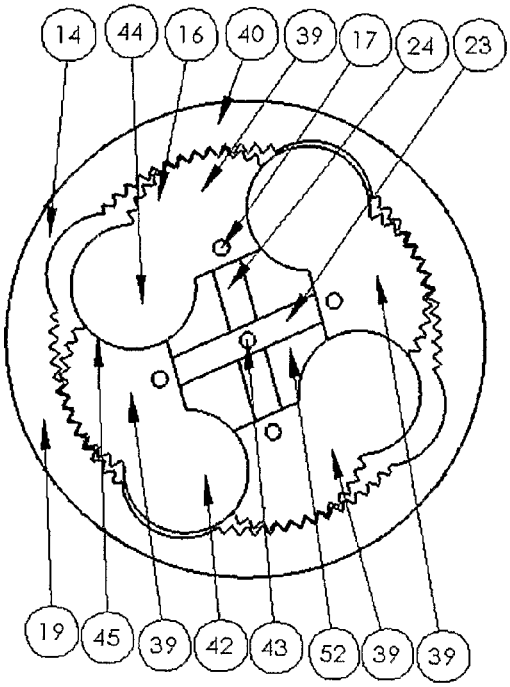
FIGS. 11*a* to 11*d* illustrate a transmission mechanism according to a second embodiment of the invention, FIGS. 11*a* and 11*b* being frontal views in two different positions of the rhomb of the machine comprising the transmission mechanism.
Figure 11B:
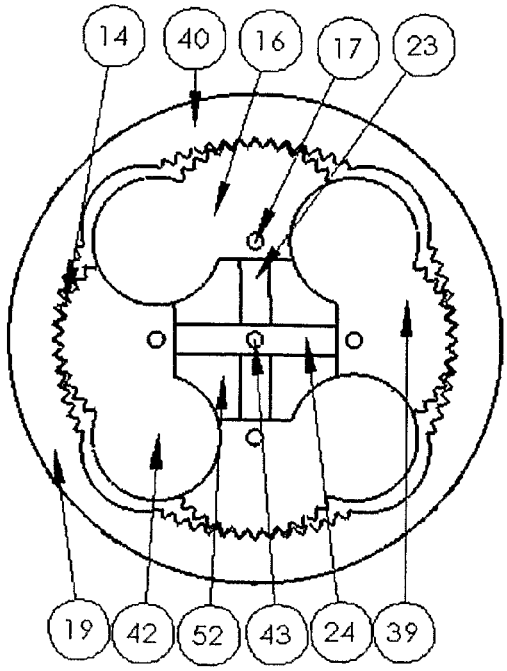
Figure 11C:
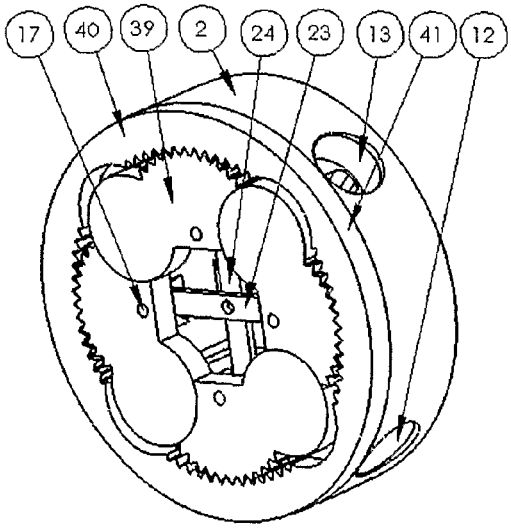
Figure 11D:
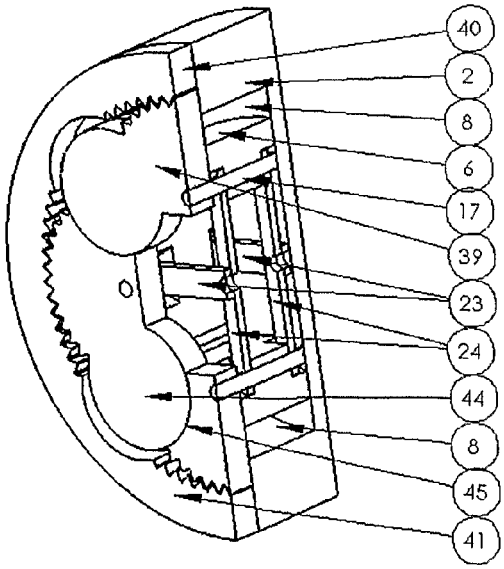

FIGS. 10*a* to 10*c* illustrate an eighth variant embodiment of a transmission mechanism 14 in which the first rolling bodies 16 and the second rolling body 19 are friction rollers similar to those of FIGS. 9*a* to 9*c*, but in which the transmission mechanism 14 uses several intermediate rolling bodies 21. More particularly, a half-roller 36 is mounted so as to be integral in movement with a piston 6, and a central roller 37 is mounted so as to be integral with the rotation shaft 15, by using a cotter 22. Three intermediate rollers 38 are held by each elongated part of a median arm 23 or respectively 24. A median arm therefore supports six intermediate rollers 38. The median arms have the same role as in the preceding variants; they are therefore mounted pivotably in articulations 29, in the centre of the opposed pistons 6, with the rotation shaft 15 passing with or without clearance in the centre of each median arm. The ends 27, 28 of the median arms 23, 24 are arranged pivotably in the centre of a piston 6, with a median arm 23 connecting the median point of a piston 6 with the tangent to the rotation shaft 15, causing one to obtain a spiral arrangement of the ends of the median arms from their centre. This permits, at each end, the supporting of several intermediate rollers 38, in a tangentially staggered manner, by their support axes 31', 31" and 31'". The advantage of such a solution is that the multiplication of the rollers allows a reduction of their diameter and hence the inertia of the transmission and its harmful consequences. However, an uneven number of intermediate rollers must be used in order to retain a positive transmission ratio. The rollers are not aligned on the median in this embodiment, which allows rollers of standard dimensions to be adapted to a machine with imposed dimensions.

FIGS. 11*a* to 11*d* illustrate a transmission mechanism 14 according to a second embodiment of the invention. The transmission mechanism 14 comprises a first rolling body 16 which is a toothed sector comprising an axis 17 which is mounted fixed in rotation in the centre of a piston 6, a toothed sector which is caused to mesh with a toothed crown 40 having and interior toothing which forms the second rolling body 19. The toothed crown 40 presents a rotation axis which is coaxial to the central axis 43 of the machine which passes through the intersection of the median arms 23, 24, with the toothed crown 40 forming the driving shaft 15 of the transmission. The median arms 23, 24 are pivotably mounted at their ends on the axes 17 which pass through the pistons 6 and have the function of supporting the radial forces acting on the pistons, the clearances in the pivotal hinges of the median arms 23, 24 being less than that of the interaxial space between a toothed sector 39 and the crown 40. The toothed crown 40 presents a cylindrical peripheral contour 41 and the toothed sectors 39 are arranged one in the extension of the other such that they form a deformable internal crown 42 having a width (in the radial direction) greater than that of an external chamber 8 of the machine. The internal deformable crown 42 is formed by articulating the toothed sectors 39 with each other, each toothed sector 39 presenting, at its ends, a protuberance 44 and a hollow zone 45, in which each protuberance 44 comes to place itself in a hollow zone 45 of the adjacent toothed sector.

This solution presents the advantage of being able to be free of any satellite pinion 48 or intermediate rolling body, which allows the clearance in the transmission to be limited, to avoid impacts, harm and damage to the parts leading to their premature wear. In addition, the dimensions of the rolling bodies are greater, for greater strength of the transmission. Furthermore, the interior toothing allows the number of teeth in contact, to be increased (conducting ratio), for a better transmission of the force. It should also be noted that the choice of the sizes of gears is more free, because it is almost independent of the dimensional parameters of the rhomb.

The centre of the rhomb is free and empty of any mechanical element. In fact, when the median arms 23, 24 are not necessary to the machine, in particular in the case of a construction in which the parts of the rotor are rigid with small clearances in the pivotal hinges 7, this free space then forms a central cavity 52 of variable volume, which allows the pumping, compressing, turbining, displacing of the fluid. This cavity can also simply provide space for the passage of components or accessories from the environment of the machine. In fact, the access to the interior of the rhomb 4 of such machines is improved here, which facilitates maintenance or repair operations. In a variant which is not shown in the figures, the inner cavity 52 could be further divided into several chambers of variable volume, for example by using tight internal walls.

In a variant embodiment (not illustrated in the figures), but using a geared transmission mechanism of the type shown in FIGS. 2 to 4 and friction rollers of the type shown in FIGS. 9 and 10, the components of the transmission mechanism 14 can divide the space of the inner cavity 10, in particular in so far as the intermediate transmission members 18 used in the transmission mechanism 14 oppose a sufficient brake to the passage of the fluid from one inner cavity 10 to the other. This can be explained with reference to FIG. 2 in which the inner cavity 10 can be divided by the components of the transmission mechanism 14 of each median arm into four variable volume cavities 10*a*, 10*b*, 10*c* and 10*d*. In such a variant embodiment, the axial clearances between the rolling bodies 16 and 19, the intermediate transmission members 18 and the lateral walls or the median arms 23, 24 should be minimal so as to ensure a tightness of the fluid present in each of the cavities 10*a* to 10*d*. The fluid can arrive in one of the cavities 10*a* to 10*d* originating from a fluid circuit external to the machine via inlet and outlet orifices formed in the lateral closure flanges of the machine. Preferably, so as to make the cavities 10*a* to 10*d* even more tight, the use of the median arms 23, 24, of shoulders on the pinions, of a non-covering zone of the flexible casings of the friction rollers are to be avoided. In fact, if one eliminates the optional median arms 23 and 24, the geared transmission (FIG. 2) is very close to the embodiment conditions (tolerances, clearances, materials, manufacture) of the geared pumps which are well known to the man skilled in the art, because the cavities are delimited by the contact zones in the gear toothings, the circular walls tangent to the summits of the toothings and the flat surfaces of the pinions which are fitted against the lateral closure walls of the machine. Likewise, the structure of a transmission mechanism with friction rollers (FIGS. 9*a* and 10*a*) is close to that of a lobe pump using lobe wheels without external synchronization, because the contact between the lobe wheels is made with a slight elastic deformation of the elastomer casing which covers the lobe wheels so as to improve the tightness and the transmission of the torque. The separations which are thus created by the transmission mechanism of the invention serve to form more cavities intended to pump, compress, turbine or displace one or several fluids, but also to amplify variations in volume or to limit dead volumes.

The closed spaces forming variable volume cavities can also be obtained by using other surfaces, such as for example the space comprised (FIGS. 11*a* and 11*b*, as described below) between the toothed sectors 39, the toothed crown 40, the stator 2 and an added lateral wall.

An example of advantageous dimensioning of such a transmission mechanism 14 according to this second embodiment is described below. The machine comprising a transmission mechanism according to FIGS. 11*a* to 11*d* is realized from a toothed crown 40 with interior toothing of module 3 with 80 teeth, and comprising four toothed sectors 39 of module 2 which would comprise 40 teeth if they were entire. The dimensions of the machine are approximately 50 mm for the height of the pistons 6, or a total height of the closed machine of approximately 100 mm and approximately 20 mm in toothing width. The interaxial space between the summits of the two opposed pistons 6 is 100 mm and the diameter of the machine is approximately 200 mm.

The contact of interior toothings on exterior toothings offers a conducting ratio (understood to be the number of teeth in contact) which is much greater, which considerably improves the lifespan of the machine and also the transmissible torque.

The space which is cleared by the omission of the satellite pinions 48 allows the primitive diameters to be increased and hence the performances of the gearing systems. In addition, for the same reasons of space gain, it is possible to adopt larger modules with more robust tooth bases, which distinctly increases the transmissible torque.

It is possible to transmit a torque of 100 N.m with alloys of the type of steel 11SMnPb30 used for standard pinions.

The omission of the satellite pinions 48 allows to eliminate one movement conversion. The estimated performance for the transmission mechanism in this case is in the order of 98%.

Figure 12A:
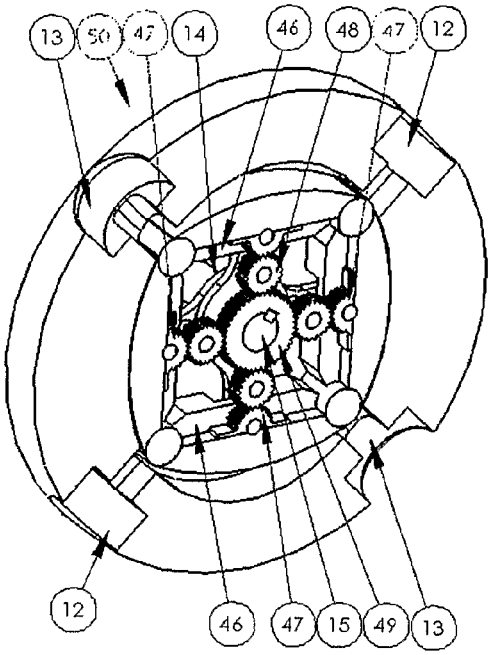
FIGS. 12*a* and 12*b* illustrate views in transverse section illustrated in perspective and FIG. 12*c* a perspective view of an example application of a machine comprising a transmission mechanism according to the first embodiment of the invention.
Figure 12B:
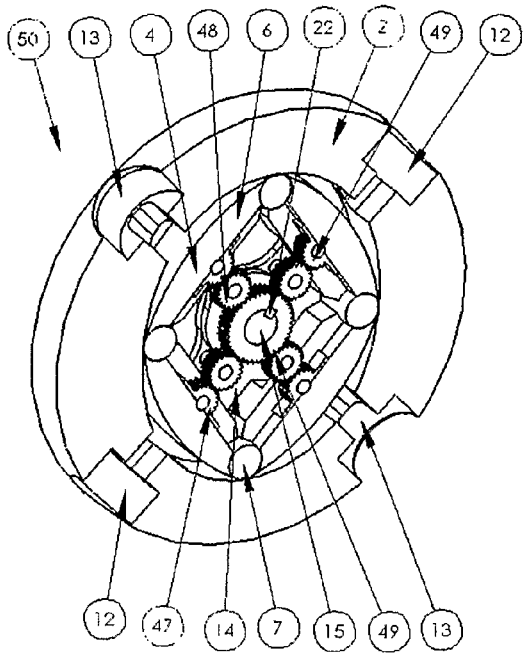
Figure 12C:
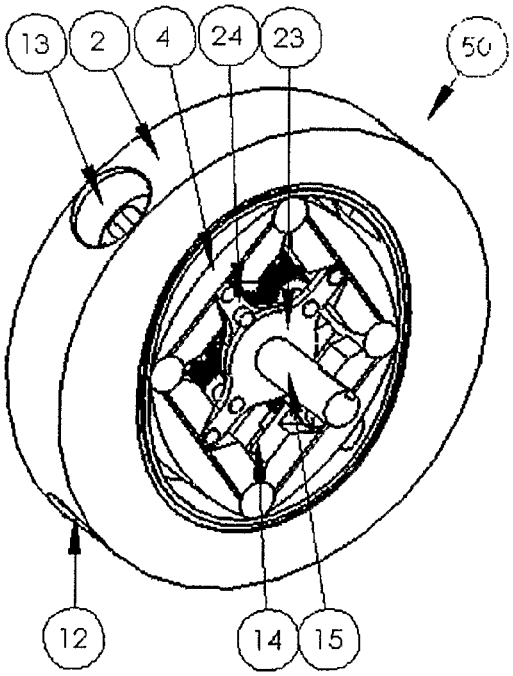
Figure 13:
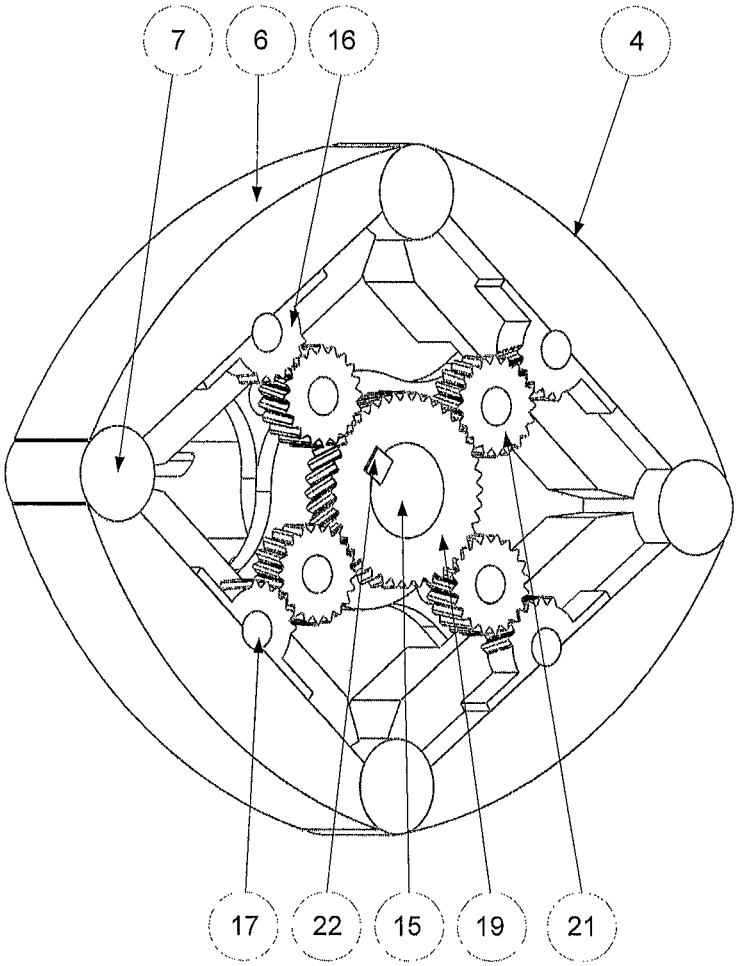
FIG. 13 illustrates a transmission mechanism that comprises gears with parallel axes and helicoidal toothing in accordance with an embodiment of the invention.

FIGS. 12*a* to 12*c* illustrate an example application of a RMDR comprising a transmission mechanism according to the invention, the machine being a fast-functioning domestic air compressor 50.

The pistons 6 comprise half-pinions 47 which are the blocks realized by electroerosion and inserted in a lightness groove 46 formed along the intrados face 11 of each piston 6. The half-pinions 47 mesh with a toothed wheel 49 fixed on the rotation shaft 15 with satellite pinions 48. The satellite pinions 48 are mounted closely on a standard pin on the median arms 23, 24. The satellite pinions 48 are guided on top and on bottom, by the median arms 23, 24. The rotation shaft 15 is a simple revolution piece linked to the toothed wheel 49, in particular by means of a cotter 22. The rotation shaft 15 has on its length circular channels or grooves intended to receive elastic fixing rings (of the circlips type, not visible in the figures) blocking in axial translation the toothed wheel 49 and blocking the axial translation of the shaft with respect to the median arms 23, 24 and hence with respect to the stator 2. In operation, the rotation torque of the rotation shaft 15 is transmitted to the pistons 6.

The dimensional and operational parameters of the different components of the machine have been designed so as to be able to transmit the desired torque, whilst presenting a silent operation, avoiding the generating of vibrations and being able to be realized for a reduced cost. Thus, in operation, the compressor 50 reaches the delivery pressure of 3 bar absolute, for an admission at atmospheric pressure with a flow of 1500 standard L/min at 3000 rounds/min, for a torque of 20 N.m.

Thus, the demultiplication is carried out at the same stage to simplify the design of the machine and to reduce the cost, complying with the gear ratio between the half-pinions 47 integral with the piston 6 and the toothed wheel 49 integral with the rotation shaft 15, which ratio must be positive and in the ratio 2:1.

Preferably straight gears are used with straight toothing for their good performance, their standardization, the absence of axial forces, and it is preferred that toothings are chosen of identical modules for all the pistons so as to simplify the design. Furthermore, advantageously the same primitive diameter of the satellite pinions 48 is selected as the primitive diameter of the half-pinions 47 of piston 6 so as to reduce the wear of the gears. The diameters of the gears and their modules were selected by dimensioning them to the maximum to optimize the performance, the wear and the transmissible torque. The satellite pinions 48 are mounted between the half-pinion 47 of piston 6 and the toothed wheel 49 of the rotation shaft 15 so as not to impede the crushing of the rhomb 4 and to obtain a maximum volume capacity.

The interaxial space in the gears (between each pair of pinions) is comprised between the nominal size and the size to which is added a clearance of 0.05 mm. These sizes are retained in operation, because the radial forces are taken up with median arms 23, 24, to prevent parasitic forces from coming to damage the gears.

Such a geared transmission mechanism is suited to transmit quite a low torque in a precise, uniform and efficient manner.

Taking into account the above considerations, the gears have been designed as a function of the dimensional parameters of the machine, in particular for a height of the pistons which is 50 mm, the total height of the closed machine being approximately 100 mm, the side of the rhomb is 100 mm and the diameter of the machine is approximately 200 mm.

For example, a module equal to 1 is selected, which ensures a reasonable number of teeth (for example greater than 17), which promotes the transmission performance (which is approximately 0.96), and also the mechanical resistance of the transmission. The toothing width which best optimizes the available space in the machine is at a maximum 17 mm, and it is desirable to select this maximum.

The materials which can be used to realize the gears are, for example, a hardened steel of the type 12NC15 or else the steel 11SMnPb30, which are currently used to produce pinions.

As regards the half-pinions 47 integral with the pistons 6, however, more resistant materials are preferred, in particular a steel of the type 42CD4 or 37D8. It is not recommended to open a pinion to make a toothed sector therefrom, because this would entail the deformation of the said pinion. For reasons of resistance to the stresses of the half-pinions 47, it is preferred to produce them by a process of cutting by electroerosion in blocks of isotropic material.

Furthermore, the small support surfaces at the level of their teeth could in the end entail a caulking of the half-pinions attached to the pistons and, consequently, introduce clearances which harm the transmission. To avoid this problem, it can be envisaged to arrange flat support surfaces on each side of the toothed sector. The profile of the teeth is symmetrical such that this piece can be mounted indiscriminately in both directions.

With these considerations and according to a dimensioning given by way of example above, the calculations have estimated a lifespan of the transmission of approximately 5000 h and a transmission performance in the order of 0.96 with little heating of the components during, operation.

In a simplified adaptation of the invention, not shown in the figures, the transmission mechanism according to the invention can also function with a single first rolling body mounted on a single piston, or with only two or three first rolling bodies mounted on respectively two or three pistons. This simplified version can be applied to the variants illustrated in FIGS. 3*a* to 3*d*, 4*a* to 4*b*, 5*a* to 5*b*, 7*a* to 7*b*, 8*a* to 8*b*, 9*a* to 9*c*, 10*a* to 10*c* and 11*a* to 11*d*. Indeed presenting disadvantages with regard to the equilibration of the masses within the transmission mechanism or with regard to the guiding of the rotor, such a structural simplification presents, however, an economical interest by allowing the cost to be reduced for realizing the transmission mechanism.

Other variants and embodiments of the invention can be envisaged without departing from the framework of the invention as delimited in the claims.

The invention claimed is:

1. A rotary machine with a deformable rhomb comprising:

a rotor formed by a deformable rhomb in contact, with an internal surface of a housing forming a stator and/or with an external surface of a central crown, said deformable rhomb comprising four pistons connected one following the other by a pivotal hinge with an axis parallel to a longitudinal axis of the housing and thus forming a closed chain;

a transmission mechanism to transmit movement between the four pistons and a rotation shaft coaxial to a central axis of the rotary machine, said transmission mechanism comprising a first rolling body mounted fixedly on at least one of the four pistons, an axis of said first rolling body passing in a center of the at least one of the four pistons and connected to a second rolling body, a center of which passing through the central axis of the rotary machine and being integral with said rotation shaft, the first rolling body being connected to the second rolling body directly or by an intermediate transmission member, wherein a gear ratio between the first and the second rolling body is equal to 2 and is positive.

2. The rotary machine according to claim 1, wherein said first rolling body and said second rolling body are provided with driving protuberances over at least a portion of their periphery for realizing a driving by obstacle.

3. The rotary machine according to claim 1, wherein said transmission mechanism comprises gears with parallel axes and straight toothing.

4. The rotary machine according to claim 1, wherein said transmission mechanism comprises gears with parallel axes and helicoidal toothing.

5. The rotary machine according to claim 1, wherein the first rolling body is a half-pinion integral with at least one of the four pistons which meshes with a toothed wheel forming the second rolling body integral with the rotation shaft of the rotary machine with an intermediate rolling body forming a satellite pinion.

6. The rotary machine according to claim 1, wherein said first rolling body is a conical half-pinion connected to said second rolling body which is a conical toothed wheel by an intermediate shaft provided with conical pinions at the ends.

7. The rotary machine according to claim 1, wherein said first rolling body is a toothed circular sector connected to the at least one of the four pistons which meshes directly with a peripheral toothed crown with interior toothing integral with the rotation shaft of the rotary machine.

8. The rotary machine according to claim 7, wherein the toothed crown presents a circular peripheral contour and the toothed sectors are arranged one in the extension of the other such that the toothed sectors form a deformable internal crown having a greater width than that of an external chamber of the rotary machine.

9. The rotary machine according to claim 7, comprising an inner cavity to the deformable rhomb comprising at least one variable volume cavity configured to pump or to expand a fluid.

10. The rotary machine according to claim 1, wherein said first rolling body and said second rolling body are connected by a chain or by a notched belt.

11. The rotary machine according to claim 10, wherein two first opposed rolling bodies are connected to the second rolling body by a shared chain or by a shared belt.

12. The rotary machine according to claim 1, wherein said first rolling body is connected to said second rolling body by a smooth belt.

13. The rotary machine according to claim 1, wherein said first rolling body and said second rolling body are friction rollers configured to each comprise a hard core covered by a flexible casing.

14. The rotary machine according to claim 13, wherein said first rolling body is connected by at least one intermediate rolling body to said second rolling body.

15. The rotary machine according to claim 1, wherein two opposed pistons of the four pistons are connected together by at least one median arm, each of the ends of said median arm being mounted pivotably to the center of each piston of the two opposed pistons of the four pistons.

16. The rotary machine according to claim 1, wherein the transmission mechanism has a reversible operation.

17. The rotary machine according to claim 1, wherein at least one of the four pistons and the first rolling body form a single-piece part.

18. The rotary machine according to claim 1, wherein the transmission mechanism allows the separation of the inner cavity of the rotary machine into several cavities of variable volume.

19. The rotary machine according to claim 1, wherein the first rolling body is mounted fixedly on each one of the four pistons.

* * * * *